US007527107B2

(12) United States Patent
Berger et al.

(10) Patent No.: US 7,527,107 B2
(45) Date of Patent: May 5, 2009

(54) WORKING TOOL WITH DAMPED HANDLE

(75) Inventors: Rudolf Berger, Grünwald (DE); Wolfgang Schmid, München (DE); Otto W. Stenzel, Neuhütten/Wüestenrot (DE)

(73) Assignee: Wacker Construction Equipment AG, Munich (DE)

( * ) Notice: Subject to any disclaimer, the term of this patent is extended or adjusted under 35 U.S.C. 154(b) by 10 days.

(21) Appl. No.: 10/595,046

(22) PCT Filed: Jul. 13, 2004

(86) PCT No.: PCT/EP2004/007743

§ 371 (c)(1),
(2), (4) Date: Jun. 9, 2006

(87) PCT Pub. No.: WO2005/007351

PCT Pub. Date: Jan. 27, 2005

(65) Prior Publication Data

US 2007/0034396 A1 Feb. 15, 2007

(30) Foreign Application Priority Data

Jul. 15, 2003 (DE) ..... 103 32 109
May 26, 2004 (DE) ..... 10 2004 025 674

(51) Int. Cl.
*B25D 17/04* (2006.01)

(52) U.S. Cl. ..... 173/162.2; 173/201; 173/212

(58) Field of Classification Search ..... 173/201, 173/162.1, 162.2, 210, 211, 170, 212; 16/431; 267/140.13, 137
See application file for complete search history.

(56) References Cited

U.S. PATENT DOCUMENTS

| | | | | | |
|---|---|---|---|---|---|
| 2,400,650 | A * | 5/1946 | Leavell et al. | 173/162.1 |
| 3,451,492 | A * | 6/1969 | Blomberg et al. | 173/162.2 |
| 4,478,293 | A * | 10/1984 | Weilenmann et al. | 173/162.2 |
| 4,800,965 | A * | 1/1989 | Keller | 173/162.2 |
| 5,095,600 | A * | 3/1992 | Allan | 29/81.16 |
| 5,927,407 | A * | 7/1999 | Gwinn et al. | 173/162.2 |
| 6,076,616 | A * | 6/2000 | Kramp et al. | 173/162.2 |
| 6,421,880 | B1 * | 7/2002 | Prajapati et al. | 16/431 |
| 6,570,298 | B2 * | 5/2003 | Yasuda | 310/328 |
| 2002/0014814 | A1 | 2/2002 | Yasuda | |

FOREIGN PATENT DOCUMENTS

| | | | |
|---|---|---|---|
| DE | 10138123 | A1 | 2/2003 |
| DE | 10158266 | A1 | 6/2003 |
| EP | 1201958 | A2 | 5/2002 |

* cited by examiner

*Primary Examiner*—Scott A. Smith
(74) *Attorney, Agent, or Firm*—Boyle Fredrickson, S.C.

(57) ABSTRACT

The invention relates to a hand-held working tool, having a first unit, powered by a vibration on operation and a second unit which may be displaced relative to the first unit. A vibration isolation device is arranged between the first and second unit, having an actuator, for generation of a control force. An operational force acting in the working direction (A) between the first and the second unit may be at least partly compensated by the control force. The actuator is pneumatically operated and comprises an air spring for vibration isolation. A working piston in an air spring percussion device on the working tool serves to supply compressed air for the air spring. Alternatively, the compressed air can be supplied by the oscillating relative movement between the first unit and the second unit.

7 Claims, 5 Drawing Sheets

WORKING TOOL WITH DAMPED HANDLE

BACKGROUND OF THE INVENTION

1. Field of the Invention

The present invention relates to a handheld working tool according to the preamble of patent claim 1, as well as to a device for vibration isolation of a handle of a working tool.

2. Description of the Related Art

Handheld working tools, in particular drilling and/or impact hammers (hereinafter referred to as 'hammers'), stampers, or the like, often have a vibration-generating device for producing a vibration that is required to achieve the desired working effect. In drilling and/or impact hammers, this is standardly a hammer mechanism with which an impact against a tool is achieved. However, the strong vibrations should affect the operator holding the tool in his/her hands as little as possible.

Working tools also standardly have a device by which vibrations, shocks, or impacts can be produced. Such devices are hereinafter designated in common as 'vibration exciters.'

Many such working tools are hand-operated, so that corresponding handles are provided by which an operator can grasp and hold the tool. The vibrations or shocks produced in the vibration exciter of the tool so that it can perform its function are transmitted to the operator via the handles, which is not only unpleasant but is also damaging to health in the long term. An effort is therefore to be made to keep the vibration in the handle as low as possible.

For this purpose, it is known to provide a vibration decoupling device between the handle and the vibration exciter. Standardly, such a vibration decoupling device is realized with the aid of passive spring damper elements. For example, rubber elements can be placed between the handle and the vibration exciter in order to achieve a certain degree of vibration decoupling. Due to the limited constructive space, the spring elements can have only small spring travel, which limits their suitability for vibration isolation of the handle. On the other hand, the spring elements must not be made too soft, in order to enable the operator to precisely guide the work tool.

Hammers are known that have anti-vibration systems with passive spring elements, in particular rubber bumpers. In order to achieve good vibration isolation under various conditions of use, in principle low spring rigidities and large spring travel are to be sought, which however are disadvantageous for the constructive size and handling of the work tool.

In particular, it must be taken into account that, for example in hammers, strongly alternating pressure forces must be dealt with. These result on the one hand from different reaction forces or recoil forces due to different tool types or non-homogenous materials that are to be processed. On the other hand, the pressure forces change due to differently acting weight forces caused by the direction of work (downward, horizontal, upward) as well as different tool weights.

It is often problematic to develop suitable spring elements that take into account all conceivable operating states, in particular the entire possible spectrum of pressure forces.

In DE 196 46 622 A1, a working tool that can be guided using a handle is described. The handle is actively vibration-damped by an actively controlled or regulated compensating element that produces a compensating force or movement dependent on the vibration transmitted to it and originating in the working tool. Through this compensation effect, it is possible largely to equalize the vibration originating in the working tool, so that the handle, connected after the compensating element, is essentially free of vibration. However, the construction expenses and control technology expenses for such a tool are significant.

DE 101 00 378 A1 describes a hand tool machine having a vibration exciter and a vibration isolation device situated between the vibration exciter and a handle. The vibration isolation device has an actuator via which the operating force can be compensated at least partly with an actuating force. Here the actuating force is largely independent of the actually existing vibration that is to be isolated. The vibration itself is compensated by a spring element, situated parallel to the actuator, that has a relatively soft characteristic. In the described working tool, the actuator itself thus does not carry out any vibration-damping function. Rather, it ensures that the working position of the spring element, i.e., its initial tension, is always within a predetermined range, so that the spring element can compensate the occurrent vibration. The actuating force of the actuator is automatically set dependent on the operating force acting from outside, in particular the pressure force of the operator. To this extent, it is possible to speak of a "semi-active" vibration isolation. The actuator can be realized electrically, electromagnetically, or hydraulically, requiring a significant constructive expense.

From DE 101 58 266 A1, a device is known for vibration damping of a handle of a machine tool, in which the handle is connected to the housing of the machine tool via at least one spring. With the aid of an actuator that acts on the spring, it is possible to keep the distance between the handle and the housing of the machine tool almost constant, independent of the actuating force exerted on the handle. The actuator has a ram that can be displaced by means of an electromagnetic, hydraulic, or pneumatic drive.

In EP 0 206 981 A2, a hand tool is described having a drive device that produces vibrations. On a housing that accommodates the drive device, a handle is provided that can be moved parallel to the main axis of vibration, limited between two stops. The handle stop situated in the direction of advance of the hand tool is fashioned as an electromagnet that exerts a constant, controllable force both on the handle and also on the housing, independent of the position of the handle relative to the housing. This is intended to achieve a vibration isolation.

OBJECT AND SUMMARY OF THE INVENTION

The present invention is based on the object of constructing a handheld working tool with semi-active vibration isolation in such a way that the constructive expense is minimized. In addition, the present invention is based on the object of indicating a device for vibration isolation of handle in a working tool with which a reliable and simple vibration decoupling of the handle is ensured even in various operating states.

According to the present invention, the object is achieved by a handheld working tool according to claim 1 for the vibration isolation of a handle in a working tool. Advantageous further developments of the present invention are defined in the dependent Claims.

A handheld working tool has a vibration insulation device between a first unit, comprising a vibration exciter, and a second unit that can be moved in at least one working direction relative to the first unit. A component of the vibration isolation device is an actuator for producing an actuating force with which an operating force, e.g. a pressure force, acting in the working direction between the first and second unit can be at least partly compensated. The actuator is pneumatically operated.

It has turned out that a pneumatically operated actuator has significant advantages in relation to the drive designs for actuators described in DE 101 00 378 A1. On the one hand, an additional medium (e.g. a hydraulic oil) is not required. Air is available as a medium at all times in sufficient quantity, and can be processed without any particular compression expense. Possible losses due to leakage are not critical. On the other hand, the regulating expense is considerably less in comparison with, for example, electrical or electromagnetic actuators. In addition, the energy expense for electrical actuators is comparatively high, because the actuators must react quickly, which is possible only through corresponding available power.

The handle air spring is so named in order to distinguish it terminologically from an air spring that is formed in particular in a pneumatic hammer mechanism of a hammer, but is here of no further interest. The handle air spring can be modified, and thus adjusted, by varying the air filling. In particular, the pressure and/or the air volume in the air spring can be changed. The actuator thus essentially forms a pneumatic spring having an adjustment device. In the handle air spring, its filling with compressed air can be modified, so that the spring characteristics of the handle air spring can also be correspondingly modified.

Due to its design, an air spring has a progressive spring characteristic. This means that the air spring has at first a relatively low spring constant, and can thus compensate vibrations effectively. The spring rigidity does not increase, making the air spring harder, until there is a significant increase of the force (operating force) acting on the air spring. In this way, the second unit (e.g. a handle) is prevented from pressing completely against the first unit (e.g. the housing surrounding the vibration exciter), which could result in the vibrations being transmitted to the second unit in almost completely unhindered fashion.

The progressivity of the air spring can be set in a corresponding manner by a suitable spring regulating device, explained below.

As already explained in connection with the prior art and presented in more detail below, the actuator has the primary task of compensating the operating force acting between the first and second unit, so that the actual vibration isolation can be taken over by a spring element situated parallel to the actuator. However, because according to the present invention the actuator is operated pneumatically, due to the compressibility of the air it already itself has good spring characteristics, and thus also acts so as to isolate vibration. A hydraulically operated actuator could not perform such a vibration isolation, due to the incompressibility of hydraulic fluid. Electrically operated actuators would also constantly try to counteract a vibration-caused deflection, thus preventing a spring effect.

In a particularly advantageous specific embodiment of the present invention, the working tool is a drilling and/or impact hammer (called 'hammer' below). The second unit has a handle by which the operator can hold and guide the working tool. In the first unit, a known pneumatic spring hammer mechanism is provided having a drive piston, driven by a motor, for driving an impact piston. Between the drive piston and the impact piston, an air spring is formed that transmits the movement of the drive piston to the impact piston, which in turn strikes a tool. According to the present invention, here the drive piston is formed in order to produce compressed air in order to power the actuator.

In this specific embodiment, an additional advantage of a pneumatically driven actuator is clear. This is because the drive piston of the hammer mechanism is already fashioned for the production of compressed air, even if, in known hammer mechanisms, this is only for the driving of the impact piston. According to the present invention, the drive piston now is assigned a second function, namely the production of compressed air for the actuator. However, because the drive piston can easily be used for this purpose, no additional components for producing a pressure medium, such as e.g. a hydraulic pump or the like, are required. The air displaced by the drive piston, e.g. in its motion back after driving the impact piston forward, can be supplied to the actuator as compressed air.

Here it is particularly advantageous if the actuator has a compressed air storage device that can be filled with compressed air by the drive piston. The compressed air storage device acts not only as a compressed air reservoir for the actuator, from which compressed air can be taken and supplied to the actuator as needed; the compressed air storage device also evens out the compressed air supplied to it in thrusts by the back-and-forth motion of the drive piston.

In a particular specific embodiment of the present invention, the actuator has a compressed air storage device, a valve device, the handle air spring, and a handle piston. Here, the compressed air storage device can be connected to the handle air spring via the valve device, while the handle air spring acts on the handle piston, which is connected to the handle. The core of the actuator is thus formed by the handle air spring. Depending on the pressure with which the handle air spring is filled from the compressed air storage device, it moves the handle piston on which it acts, which in turn is connected positively to the handle and thus moves it concomitantly. The valve device thus ensures that only as much compressed air moves from the compressed air storage device into the handle air spring as is required.

Advantageously, the valve device is fashioned such that when the handle piston reduces a volume enclosing the handle air spring by more than a predetermined amount, compressed air can be moved from the compressed air storage device into the handle air spring in order to restore the predetermined value for the volume of the handle air spring. Thus, if the operator presses against the handle with an increased operating force, he moves the handle and thus moves the handle piston against the action of the handle air spring. Due to the compressibility of the air, the volume of the handle air spring is reduced, until finally a predetermined minimum boundary value is reached. The valve device thereupon opens the connection between the compressed air storage device and the handle air spring, so that the air pressure in the handle air spring is increased. As a result of this, the force acting on the handle piston increases and again presses the piston against the action of the operating force. Given a corresponding setting of the system, it can thus be ensured that the handle changes its position relative to the first unit, including the pneumatic spring hammer mechanism, only very slightly.

In addition to this, it is useful if the valve device also has an outlet valve in order to let compressed air out of the handle air spring when the volume of the handle air spring increases beyond a predetermined maximum value due to a displacement of the handle piston.

This case can for example occur if the operator first presses against the handle with a high operating force, and then finally reduces the operating force because he wishes to lift the device. As a result, the high air pressure in the handle air spring would press the handle piston, and thus the handle, further outward, which, in particular given a new placement of the tool against a surface with a low operating force, would have the result that the vibration isolation would not operate in the optimal operating range.

In order to prevent this, the outlet valve is provided, which opens a connection from the handle air spring to the outside if, due to a reduction of the operating force, the handle air spring moves the handle piston, and thus becomes larger than a predetermined maximum value.

The last-described specific embodiments of the present invention can be realized both purely mechanically and also mechanically-electronically (mechatronically).

In the mechanical solution, the valve device is preferably coupled to the handle piston. The handle piston is capable of movement between two extreme positions, depending on the pressure it receives from the handle air spring. Before these two extreme positions, piston positions can be defined that correspond to a minimum value and a maximum value for the volume of the handle air spring. Within these values, compressed air should not be supplied to or removed from the handle air spring. However, as soon as the position of the handle piston exceeds one of the two boundary values (maximum value or minimum value) due to a changed operating force, the valve device opens an allocated valve, i.e., either an inlet valve that creates a connection between the compressed air storage device and the handle air spring, or the outlet valve for letting compressed air out. In order to realize this, the valve device has corresponding inlet ports for the inlet valve and outlet ports for the outlet valve, which are opened or closed dependent on the position of the handle piston. The ports, and their closing or opening mechanisms, can easily be combined with the handle piston.

In the mechatronic solution, it is particularly advantageous if a sensor is provided that can determine the relative position of the first and the second unit, i.e., in particular of the main housing, accommodating the hammer mechanism and the drive, and of the handle that can be moved relative thereto. The sensor should be situated in such a way that it is capable of acquiring at least the point of the optimal relative position between the two units.

Preferably, the sensor and the valve device are connected to a control unit, the valve device being capable of being controlled by the control unit in such a way that in the handle air spring a compressed air state prevails such that the relative positions, acquired by the sensor, of the first and the second unit arc maintained within a predetermined range of fluctuation. The range of fluctuation is defined for example by the above-described maximum value and minimum value for the volume of the handle air spring. With the aid of the sensor, the control unit monitors the relative position between the first and the second unit, and can initiate corresponding countermeasures with the aid of the valve device if the predetermined range of fluctuation is exceeded. On the one hand, in this way it is possible to cause compressed air to flow from the compressed air storage device into the handle air spring via the inlet valve. On the other hand, the control unit can also cause the handle air spring to be relieved of stress via the outlet valve.

In a particularly advantageous specific embodiment of the present invention, a spring device is situated parallel to the actuator between the first and the second unit. The spring device can have a softer spring characteristic than the actuator.

Alternatively, it is possible for the spring device to have a spring rigidity that is at least great enough that the spring device can absorb the movement of an amplitude of the vibration without bottoming out.

The force acting between the first unit and the second unit is essentially made up of two components. On the one hand, the operating force acts that is essentially applied externally by the operator by pressing the handle. On this operating force there is superimposed a force produced by the vibration excited in the first unit. Due to the construction according to the present invention, it is possible for the operating force to be largely completely absorbed by the actuator and compensated, the actuator ideally having zero spring rigidity or a very low spring rigidity. A slight increase in the force acting on the actuator in the low-frequency range would bring about a displacement of the actuator ram, without the actuator first counteracting an increased counterforce. The actuator force would be increased only when the boundary positions were exceeded.

Superimposed on this is the action of the spring device, which receives the changes in force and/or travel caused by the vibration amplitude. The vibration amplitude in turn is not influenced by the operating force, or is influenced only very slightly by it. Therefore, the spring device must have a spring rigidity that is capable of completely absorbing the vibration amplitude without bottoming out, i.e., without the spring device being compressed so far that corresponding stops come into contact, preventing a further compression of the spring. Because the vibration amplitudes that occur during operation are essentially known ahead of time, the spring device can be designed correspondingly.

Otherwise, however, the spring rigidity of the spring device should be as low as possible, in order to enable an especially soft cushioning.

In this way, it is possible for the actuator to compensate, in the manner described above, the operating force acting externally on the working tool between the first and the second unit, the operating force effecting no significant deformation of the soft spring device. In contrast, the spring device is suitable for compensating the higher-frequency vibrations that arise in the first unit due to the vibration exciter, so that the second unit is essentially isolated from vibrations.

The spring device therefore need not be deformable over the entire range of conceivable operating forces, which, due to the soft spring characteristic, would result in a large constructive length of the spring. Rather, due to the compensation of the operating force by the actuator it is possible that the spring device need provide only a relatively small operating range for the relative movement between the first and the second unit, so that the spring device has a short construction, despite the soft spring characteristic.

In an advantageous farther development, the actuating force produced by the actuator can be modified in cyclical fashion, the modifying taking place with the same frequency with which the drive piston moves. The vibration produced in the pneumatic spring hammer mechanism by the drive piston necessarily has exactly the same frequency with which the drive piston also moves. Correspondingly, the frequency of the vibration to be isolated is already predetermined by the frequency of motion of the drive piston. If the actuator now operates with the same frequency, the action of the actuator, which pulsates in a certain manner, is able to compensate the vibration caused by the drive piston.

Phase shifts that may be required with respect to the movement of the drive piston and the actuating work of the actuator can be achieved through a suitable coupling of valves of the valve device and the intermediate connection of the compressed air storage device. Thus, it is for example possible for the drive piston, after it strikes the impact piston and the impact piston executes the impact, to pump air into the compressed air storage device during its return movement. During the impact action taking place in the next cycle, and the vibration caused by this, the valve opens between the compressed air storage device and the handle air spring, in order to increase the pressure in the handle air spring and thus to increase the force effect. When the working piston moves back again, the handle air spring is emptied, while the compressed air storage device is refilled. This specific embodiment of the present invention enables a particularly well-suited and reliable compensation of the undesirable vibration effect at the handle.

Alternatively to the specific embodiment described above, in another specific embodiment of the present invention the maximum actuating frequency of the actuator can be smaller than the frequency of the vibration produced in the first unit, i.e., in particular than the frequency of movement of the drive piston. This ensures that the actuator compensates only the operating force acting from the outside, but does not actively counteract the vibration. Instead of this, the vibration is compensated in the above-described manner by the softer spring device, or, due to the compressibility of the air, is also passively compensated by the actuator.

In another specific embodiment of the present invention, a compressed air-producing device, driven by the drive of the working tool, is provided that produces compressed air for the actuator, independent of the actual working function of the tool. A small screw compressor is for example suitable for this purpose.

The actuating force of the actuator should be capable of being adjusted in such a way that a range of fluctuation for the relative positions, caused by different operating forces, between the first unit and the second unit is ensured that is smaller than a range of fluctuation that would be achieved by the relative positions between the first and the second unit given the same difference in operating forces, but without the compensating effect of the actuating force of the actuator. This means that the first and second unit would be capable of being moved in a significantly larger range relative to one another without the action of the actuator. In contrast, the actuator ensures that this range of fluctuation is as small as possible in order to achieve the best possible vibration isolation there, e.g. with the aid of the spring device connected in parallel.

According to the present invention, a force-producing pneumatic actuator is thus described that compensates the pressure force averaged over a particular period of time, as in the case of a leveling control device. The actual vibration isolation is achieved either only by the spring characteristic of the air cushion in the handle air spring itself, or in addition by the connection in parallel of the passive spring device having sufficiently low spring rigidity. This means that the flat spring characteristic during the vibration process is shifted when the pressure force changes, in such a way that in the ideal case the vibration oscillates about a defined point. Although a semi-active vibration isolation has essentially been described above, in particular in the case of the mechatronic variant it is conceivable, with the same design, also to achieve a completely active compensation; in this case, the demands placed on sensors, the control system, and valves are higher due to the increasing switching frequencies. Conversely, in the case of the semi-active vibration isolation the demands made on the components are significantly less, because the actual vibration isolation takes place only passively.

The force characteristics of the actuator, which in addition can also be made up of a plurality of small actuators, as well as the passive spring device, which can also have a plurality of spring elements, are to be matched to one another in such a way that at least the maximum conceivable operating force can be compensated. Thus, on the one hand it is possible to combine a strong actuator with a spring device having a very soft characteristic, while on the other hand a more rigid spring device enables a weaker construction of the actuator.

The handle air spring should be constructed as large as possible, because the relative change in volume due to the handle movement is then small, so that the effective force remains nearly constant.

If the piston surface of the handle piston is constructed sufficiently large, the operating pressure in the handle air spring can be kept low. In this way, the change in the spring rigidity of the air spring can also be kept low in relation to the change in the operating force.

The device for vibration isolation has a vibration exciter and a grip device that can be moved relative to the vibration exciter along a main direction, e.g. the operating direction of the working tool. Between the vibration exciter and the grip device, a vibration decoupling device is provided that has a spring device via which an essential part of the forces acting between the grip device and the vibration exciter is transmitted. In addition, the vibration decoupling device has a spring regulating device for changing the spring rigidity and/or the initial tension of the spring device dependent on a force acting in the main direction between the grip device and the vibration exciter, in particular the holding force exerted by the operator on the grip device in the main direction.

Due to the unambiguous relation between force and travel in the spring device, a position (relative position) can also be used as a manipulated quantity.

In order to achieve as good a vibration isolation as possible, it is fundamentally important to use a spring that is as soft as possible, i.e., a spring device having low spring rigidity. However, such a spring has the disadvantage that low forces can already cause a significant deformation path of the spring. With regard to the working tool, this means that the grip device can be moved relative to the vibration exciter over larger paths if the spring device situated therebetween has a soft characteristic. However, this can be disadvantageous for guiding the tool, and requires constructive space which in many cases is not available. In particular, the constructive length in the main direction of the working tool is significantly enlarged.

It is true that a spring device having a hard characteristic, i.e., a rigid spring, enables a minimization of the constructive space. At the same time, however, the vibrations of the vibration exciter are kept away from the handle only incompletely.

Up to now, in the prior art it was possible only to find a compromise between a hard and soft characteristic for the spring device. The present invention now makes it possible, with the aid of the spring regulating device, to adapt the spring rigidity, or, alternatively or in addition, also the initial tension of the spring device, to the external conditions that obtain in the particular case, in particular the effective force, and to set the spring characteristics in such a way that the permissible spring travel and the permissible relative displacement between the grip device and the vibration exciter can be fully exploited.

The force applied by the operator changes, if it changes at all, only relatively slowly in a low-frequency range. Even a shock-type loading by the operator takes place with a low frequency.

In contrast to this, the vibrations produced by the vibration exciter in the working tool have a higher frequency. The vibration-caused changes in force between the grip device and the vibration exciter are not acquired by the spring regulating device. The spring regulating device thus reacts only to the forces applied by the operator by holding or pressing on the working tool.

In this way, it is possible in principle to set the spring device to the softest possible characteristic, or to a low initial tension force. The constructively predetermined permissible movability between the grip device and the vibration exciter can then be fully used as a vibration path in order to compensate the vibrations. Depending on the design of the spring device, the spring rigidity can be influenced in the relative operating point by changing the initial tension or the spring characteristic (changing the air quantity in an air spring).

If, however, the operator presses with a stronger holding force against the grip device, and thus against the working tool, the danger arises that the grip device will come into contact with the vibration exciter. In any case, given unchanged spring rigidity of the spring device, the vibration path available for vibration isolation would be more and more limited. This is compensated by the spring regulating device in that, given a statically acting holding force of the operator and thus a zero position of the vibration, a displacement of the grip device relative to the vibration exciter is brought about in such a way that the grip device is situated in a predetermined target position.

When the operator presses against the grip device with a greater force, the spring regulating device increases the spring rigidity in order to compensate the operating force with sufficient spring force. Regarded statically, the grip device thus remains in the predetermined target position. When charged with the vibration, the grip device can move within a predetermined operating range relative to the vibration exciter, because the higher-frequency changes in force caused by the vibration are not controlled out.

Advantageously, the position of the grip device relative to the vibration exciter is held in the predetermined operating range by the spring regulating device working together with the acting force. The spring regulating device thus ensures that the relative position always remains within the predetermined operating range. In this way, it is possible to avoid extreme positions, and thus for example physical contact between the grip device and the vibration exciter, in which the vibrations would be transmitted completely to the grip device.

Preferably, even given a changing holding force the spring regulating device tends to hold the grip device essentially in a target position in the operating range, said target position corresponding to a predetermined relative position between the grip device and the vibration exciter.

It is particularly advantageous if the target position simultaneously corresponds to a center position of the operating range, so that the grip device is capable of being moved forwards and backwards from the center position over essentially equally long movement paths to boundary or end positions in each direction along the main direction. In this way, the grip device can oscillate symmetrically about the center position, thus compensating the vibration produced by the vibration exciter.

In a particularly advantageous specific embodiment of the present invention, the spring device can be controlled by the spring regulating device in such a way that in no-load or idle operation, in which the force acting between the grip device and the vibration exciter is less than a predetermined boundary value, the spring device has an increased rigidity. It has turned out that in particular hammers, when they are placed on a new drilling point, have a tendency to jump away from the point at which they are placed. If the spring device has a soft characteristic, in principle the working tool is more difficult to maneuver, which further contributes to the jumping away. However, if the spring device has an increased rigidity, the working tool can be guided especially reliably when being put into place, if the operator does not yet press on the tool with the full force, i.e., applies a force below the predetermined boundary value.

However, as soon as the working tool enters into normal working operation and is held by the operator with a correspondingly higher holding force, greater than a predetermined boundary value, the rigidity of the spring device can be reduced by the spring regulating device in such a way that the grip device can be situated in the desired target position in the operating range.

In the startup phase of the work process, in which the working tool is still in no-load operation, the spring device is thus rigid in order to ensure good maneuverability. At the moment at which the operator presses on the working tool, desiring a transition from no-load operation to working operation, the spring rigidity is reduced in order to achieve improved vibration isolation. The spring rigidity will then necessarily not be too low, because the pressure force of the operator must be compensated by the operator. Correspondingly, in working operation a good maneuverability of the working tool is ensured.

In a particularly advantageous specific embodiment of the present invention, the spring device has an air spring acting between the grip device and the vibration exciter that preferably receives air from an air pump.

The air pump can be operated by a drive motor of the working tool. For example, the air pump can be coupled to a fall impeller for the drive motor, or can be situated as an additional pump element.

The air pump is here intended to represent many other possibilities for the realization of an air pressure-producing device with which air under pressure can be supplied to the air spring. Correspondingly, when an 'air pump' is discussed in the following, this is to be understood as referring in general to an air conveying device or an air pressure-producing device.

In a particularly advantageous further development of the present invention, the air pump is operated by the oscillating relative movement between the grip device and the vibration exciter. Due to the relative movement of the grip device required for the vibration isolation, a drive movement is present that can advantageously be used for the air pump.

Thus, for example the air pump has a pump chamber, situated between the grip device and the vibration exciter, whose volume changes constantly as a result of the oscillating relative movement. However, the air pump can also be situated between the vibration exciter and a third mass. Via a first check valve, air can flow from the surrounding environment into the pump chamber when the volume of the pump chamber becomes larger. Via a second check valve, the air can be conveyed from the pump chamber into an air spring chamber, in which the air spring is formed, when the volume of the pump chamber becomes smaller given a corresponding counter-movement of the grip device. Through the interplay between the first and the second check valve, an air supply flow from the air pump to the air spring is ensured that is essentially constant, averaged over time.

The spring regulating device has a valve device by which the stream of exhaust air coming out of the air spring can be controlled dependent on the relative position of the grip device. The rigidity of the spring device can thus be adjusted by regulating the exhaust air stream. When more air flows out of the air spring than is supplied by the air pump, the spring rigidity is reduced. Conversely, the spring rigidity can be increased by setting the exhaust air stream lower than the supply air stream, so that overall more air flows into the air spring.

In a particularly advantageous specific embodiment of the present invention, the valve device has a valve opening that can be opened when the grip device is removed further from the vibration exciter. In this way, air can flow out of the air spring, so that the spring rigidity decreases. Given an unchanged strength of the pressure force applied by the operator, this has the result that the grip device moves closer to the vibration exciter. When the grip device, approaching the vibration exciter, has moved past the target or center position of the operating range, the valve opening can be at least partly closed again. This increases the air pressure in the air spring and the air spring becomes more rigid. Correspondingly, the grip device cannot approach closer to the vibration exciter. If necessary, the grip device is even pressed back by the continuously increasing air pressure in the air spring, so that it assumes the desired target position.

In another specific embodiment of the present invention, the spring regulating device has a valve device by which the air supply stream to the air spring can be regulated dependent on the relative position of the grip device. The exhaust air stream from the air spring is here essentially constant. As a result, the air pressure in the air spring can thus be regulated in a manner similar to that already described above.

Of course, a combined solution is also possible in which both the air supply stream and the exhaust air stream are regulated. Here, however, it is useful to match the two air streams to one another, which in some circumstances increases the control expense.

In another specific embodiment of the present invention, the increase in pressure is achieved not by adding to the quantity of gas in the spring volume of the air spring, but rather by reducing the volume, the quantity of gas remaining constant.

This actuating task, to be achieved for example by an actuating element, can for example take place by letting a fluid—separated from the actual air volume of the air spring by a membrane or by a piston—into or out of a hollow space coupled to the air spring. Alternatively, a piston or a bellows wall can be moved by a mechanical drive, thus changing the volume of the quantity of air in the air spring. In this case, the gas space for the air spring is hermetically sealed. It could therefore also be filled with a gas other than air. For example, given the use of a monatomic gas (inert gas), the adiabatic losses would be lower, so that the "air spring" would heat up less. For this purpose, it is recommended to fill the spring with helium, neon, argon (economical), or krypton.

For such cases of a sealed gas volume whose pressure can be changed from the outside in the above-described manner, the designation 'air spring' is expressly intended also to include gas springs filled with gases other than air. The designation as an air spring is thus used only for easier comprehension; in the present context it must not be understood as a limitation to the effect that only spring fillings with air are included. In this sense, an air spring is synonymous with a gas spring.

The grip device can have at least one, but also two or more, hand grips.

In a preferred specific embodiment of the present invention, an elastic stop is provided between the grip device and the vibration exciter. At least a part of the force acting between the grip device and the vibration exciter can be transmitted via the stop if the spring rigidity of the spring device is not sufficient to transmit the entire force. The stop thus corresponds to a classical spring element (e.g. a rubber spring or a foam element). However, it transmits forces only in one direction. In this way, it can be ensured that for example the pressure or holding force of the operator can, if necessary, be transmitted from the grip device directly via the stop to the vibration exciter. The elastic stop ensures that even in this case a vibration decoupling is possible, though it may be less. Of course, a second stop can also be provided that receives forces in the opposite direction, in particular if the working tool is rapidly relieved of stress by the operator, or the supporting ground yields suddenly tinder the action of the pressure force.

The working tools to which the present invention relates, in particular hammers, are often used in dusty environments (e.g., demolition worksites). The air suctioned for the filling of the air spring should therefore be cleaned at least by a filter. Due to the large amount of dust, however, these filters will quickly become full, which, given insufficient maintenance, can result in stoppage or choking of the suctioned-in air stream for the air spring; it can also result in larger quantities of dust being allowed in. In this case, increased wear is to be expected, in particular due to changing relative movements. It is therefore advantageous if the air let out of the air spring can be at least partly collected in a largely sealed space, e.g. a bellows or a filter bag, from which it can be reused to refill the air spring. The exhaust opening from the air spring, as well as the inlet opening of the air pump, can then open into this space.

In another preferred specific embodiment, the air for the air spring can correspondingly be supplied from an air storage device. Here it is particularly advantageous if the air let out from the air spring can be fed back into the air storage device. This means that the air can be buffered in the air storage device acting as an intermediate reservoir before being blown under pressure into the air spring by the air pump. In this way, it is possible to keep the exchange of the air provided for the air spring with the surrounding environmental air low, in order to minimize contamination, e.g. by dust. An essentially closed air circuit is thus achieved, in which only the most unavoidable leakage losses need be compensated by fresh air from the outside.

As an air storage device or intermediate reservoir, for example a hollow space is suitable, in particular a bellows or a balloon, whose volume can adapt to the required quantity of air.

The constant compression and decompression of the air (of the gas) due to the introduction of vibration produces losses in the air spring that result in heating of the air (of the gas). The lost heat must be conducted away via the walls of the air spring. Therefore, it can be useful to provide cooling fins on the inner and outer surface of the space surrounding the air spring.

These and additional features of the present invention are explained in more detail in the following on the basis of examples, with the aid of the accompanying Figures.

DETAILED DESCRIPTION OF THE PREFERRED EMBODIMENT

Figure 1:
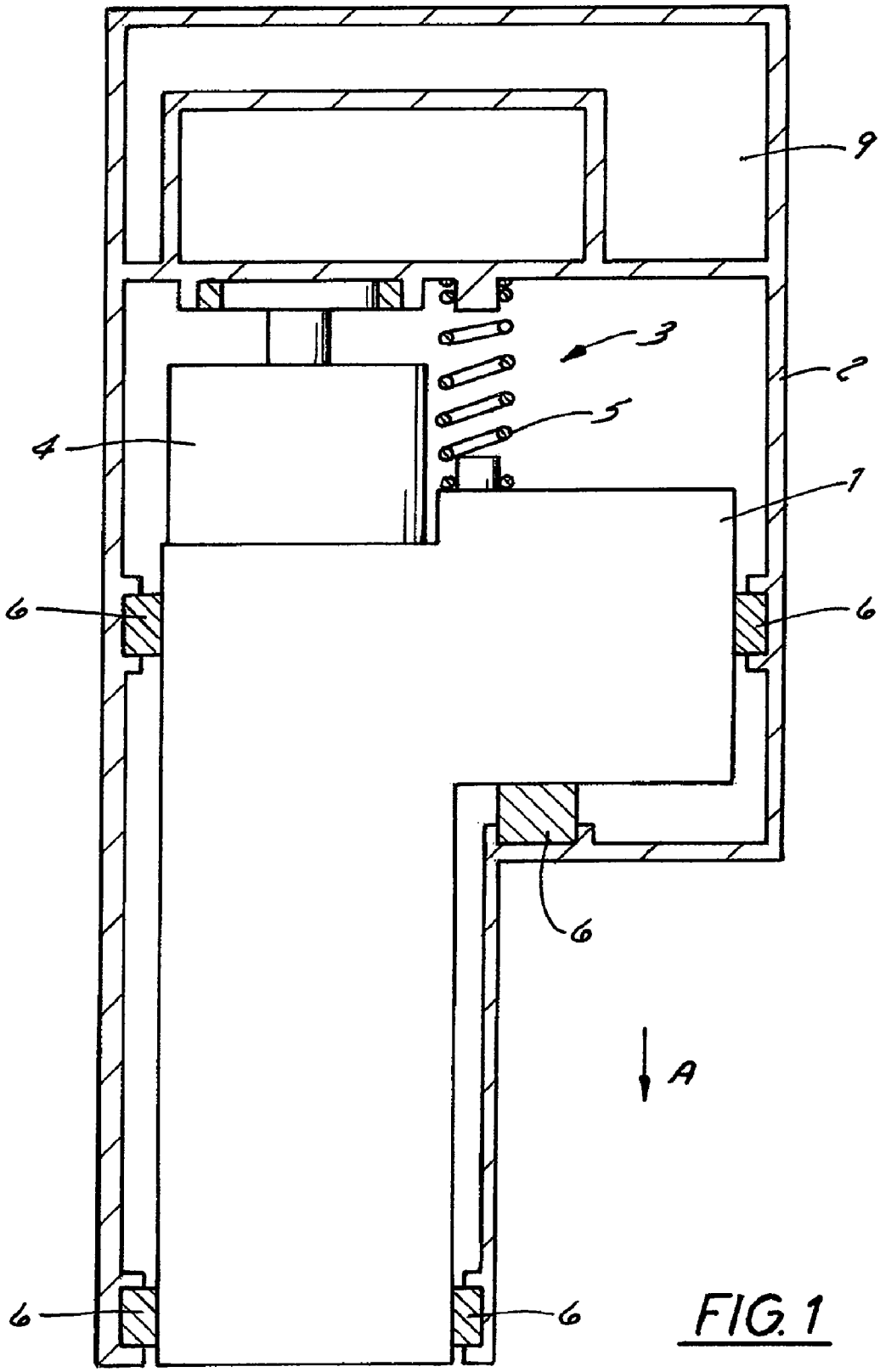
FIG. 1 schematically shows a sectional side view of a working tool according to the present invention.

FIG. 1 shows the design of the working tool according to the present invention for the example of a drilling and/or impact hammer. A first unit 1 and a second unit 2 are connected to one another via a vibration isolation device 3.

Vibration isolation device 3 has an actuator 4 and a spring device 5.

In addition, guide elements 6 are situated between first unit 1 and second unit 2 that are intended to prevent jamming of the two units 1, 2. Guide elements 6 can be made of rubber or plastic, and can thus also contribute to the vibration isolation.

In first unit 1 there is situated, in a known manner (therefore not shown in detail), a drive motor that moves a drive piston 7 (visible in FIG. 2) back and forth via a crankshaft. Before drive piston 7, i.e. in a working direction A, there is situated an impact piston (not shown). Due to the movement of drive piston 7, an air spring 8 forms between drive piston 7 and the impact piston, which air spring in turn drives the impact piston, so that it strikes a tool end or intermediately situated header (not shown). The functioning of such pneumatic spring hammer mechanisms is known, so that a more detailed presentation is not necessary here.

A handle 9 is fashioned at the rear end of second unit 2.

Figure 2:
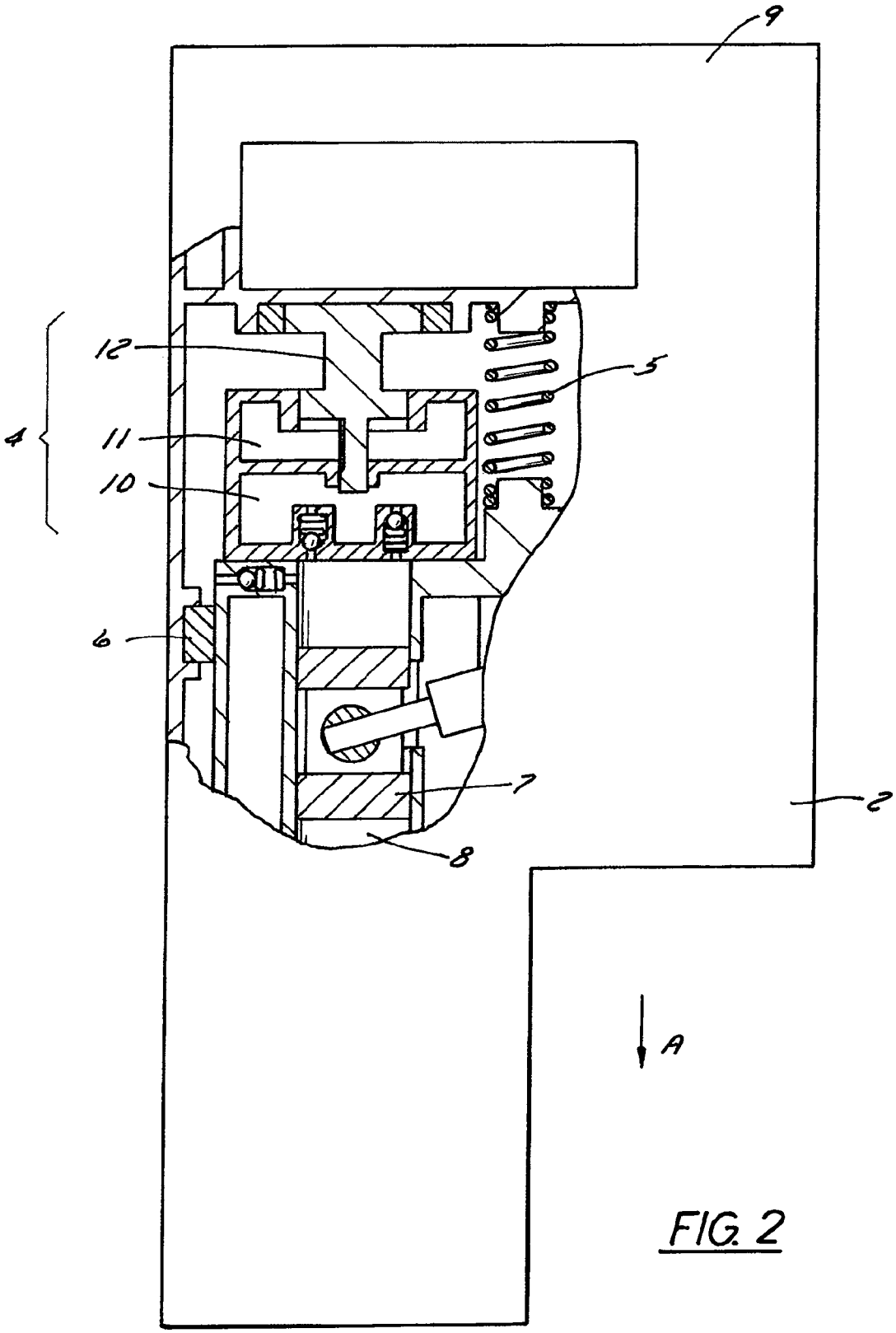
FIG. 2 shows the working tool from FIG. 1 with a partially sectional view of the hammer mechanism and an actuator according to the present invention.
Figure 3:
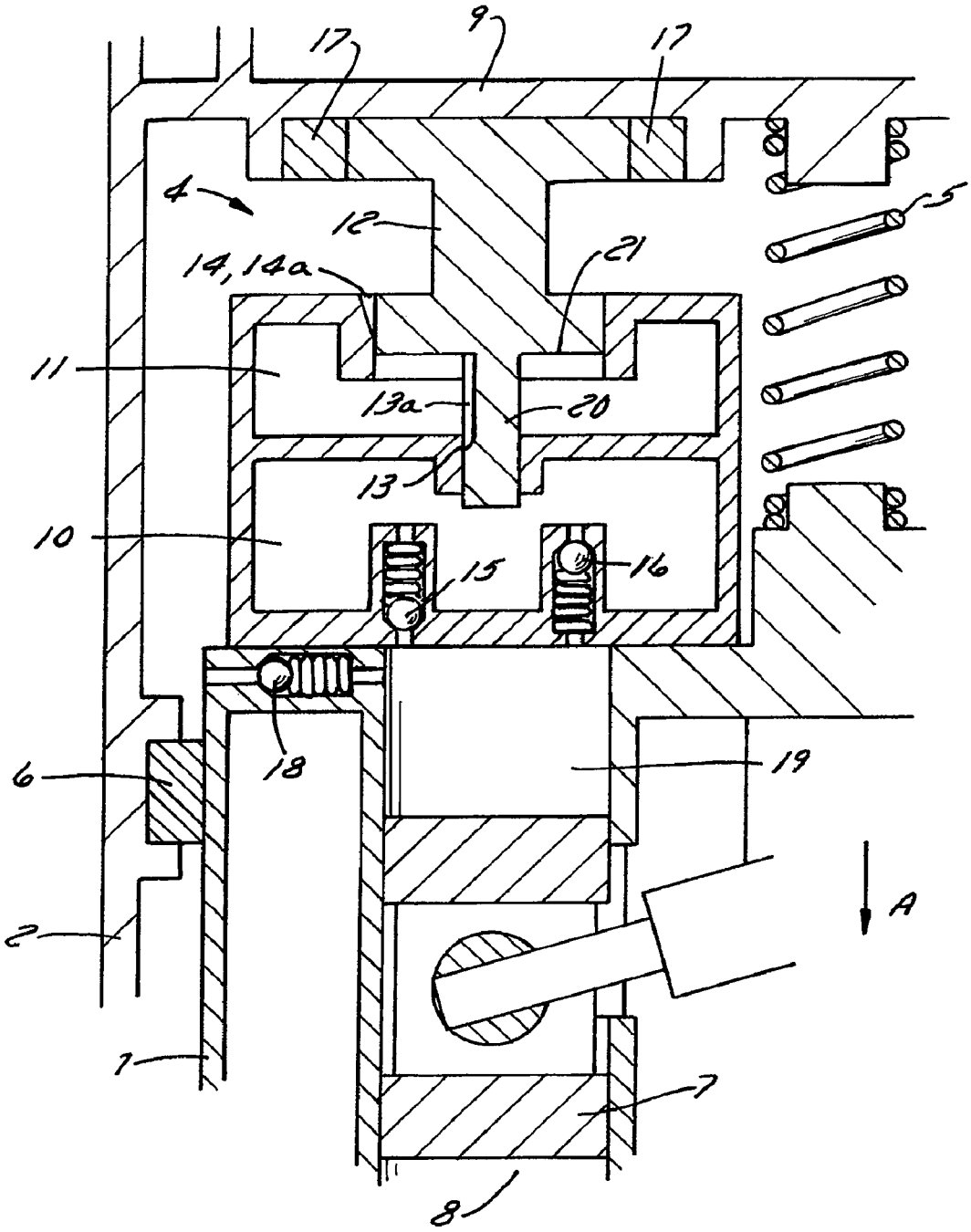
FIG. 3 shows an enlarged detail from FIG. 2.

Because FIGS. 2 and 3 essentially relate to the same representation, in the following they are described together.

Actuator 4 has a compressed air storage device 10, a handle air spring 11, and a handle piston 12. In addition, the actuator has as a component a valve device comprising an inlet valve 13 and an outlet valve 14. Inlet valve 13 and outlet valve 14 arc essentially made up of a groove that is milled into a cylinder and that is situated opposite a closed cylinder surface. Its functioning is described in more detail below.

In addition, compressed air storage device 10 is provided with an inlet check valve 15 and an outlet check valve 16.

Handle piston 12 is connected positively to handle 9 in the axial direction. In order to compensate possible alignment errors, lateral movements, or angular errors, an annular rubber or foam element 17 is provided. It is ensured in all cases that the axial movement of handle piston 12 is transmitted precisely to handle 9, and vice versa.

In the following, the functioning is explained:

During operation, drive piston 7, during a forward movement in working direction A, suctions air from the surrounding environment into a rear chamber 19 via a check valve 18. In the subsequent movement back of drive piston 7 opposite working direction A, the air from rear chamber 19 is pressed into compressed air storage device 10 via inlet check valve 15. In the subsequent forward movement of drive piston 7, air is then again suctioned in via check valve 18. If an excess pressure arises in compressed air storage device 10, this excess pressure can be dismantled via outlet check valve 16.

If the operator now presses the hammer at handle 9 against a stone that is to be worked, handle 9 moves forward relative to first unit 1, in working direction A. As a result, handle piston 12 also penetrates with a ram 20 deeper into compressed air storage device 10, until a communicating connection is created between compressed air storage device 10 and handle air spring 11 via a groove 13*a* of inlet valve 13. Via this connection, compressed air can flow from compressed air storage device 10 into handle air spring 11, which spring, among other things, acts against a piston surface 21, and finally moves handle piston 12, together with handle 9 and second unit 2, back again, in the direction opposite working direction A. In this way, the disturbing relative movement between first unit 1 and second unit 2 can be compensated in a very short time.

If the operator presses against handle 9 with a still higher operating force, the above-described procedure is repeated.

If, in contrast, the operator relieves the pressure on handle 9, or even lifts the working tool by handle 9, then handle 9, together with second unit 2, moves toward the rear relative to first unit 1, opposite working direction A. As a result, handle piston 12 also slides back, and finally exposes groove 14*a* on outlet valve 14, so that compressed air can flow from handle air spring 11 to the surrounding environment, until the compressed air in handle air spring 11 has been completely dismantled.

In addition, second unit 2 is secured at the first unit by stops (not shown), e.g. also via guide elements 6, in order to prevent a complete detachment of second unit 2. The stops ensure that outlet valve 14 is opened without handle piston 12 sliding completely out of its guide.

Due to the compressible properties of the compressed air in handle air spring 11, actuator 4 is already able to isolate vibrations to a large extent. In addition, in the specific embodiment shown in FIGS. 1 to 3, spring device 5 is provided in the form of a coil spring having a soft spring characteristic. Without actuator 4, spring device 5 would be completely compressed given even a slight operating force at handle 9, so that it would no longer have any vibration-isolating effect. However, with the aid of actuator 4 it is possible to maintain the relative position shown in the Figures between first unit 1 and second unit 2, so that spring device 5 can continue to provide a sufficient spring travel. This spring travel is suitable to effectively isolate the vibration produced in first unit 1 from handle 9.

Figure 4:
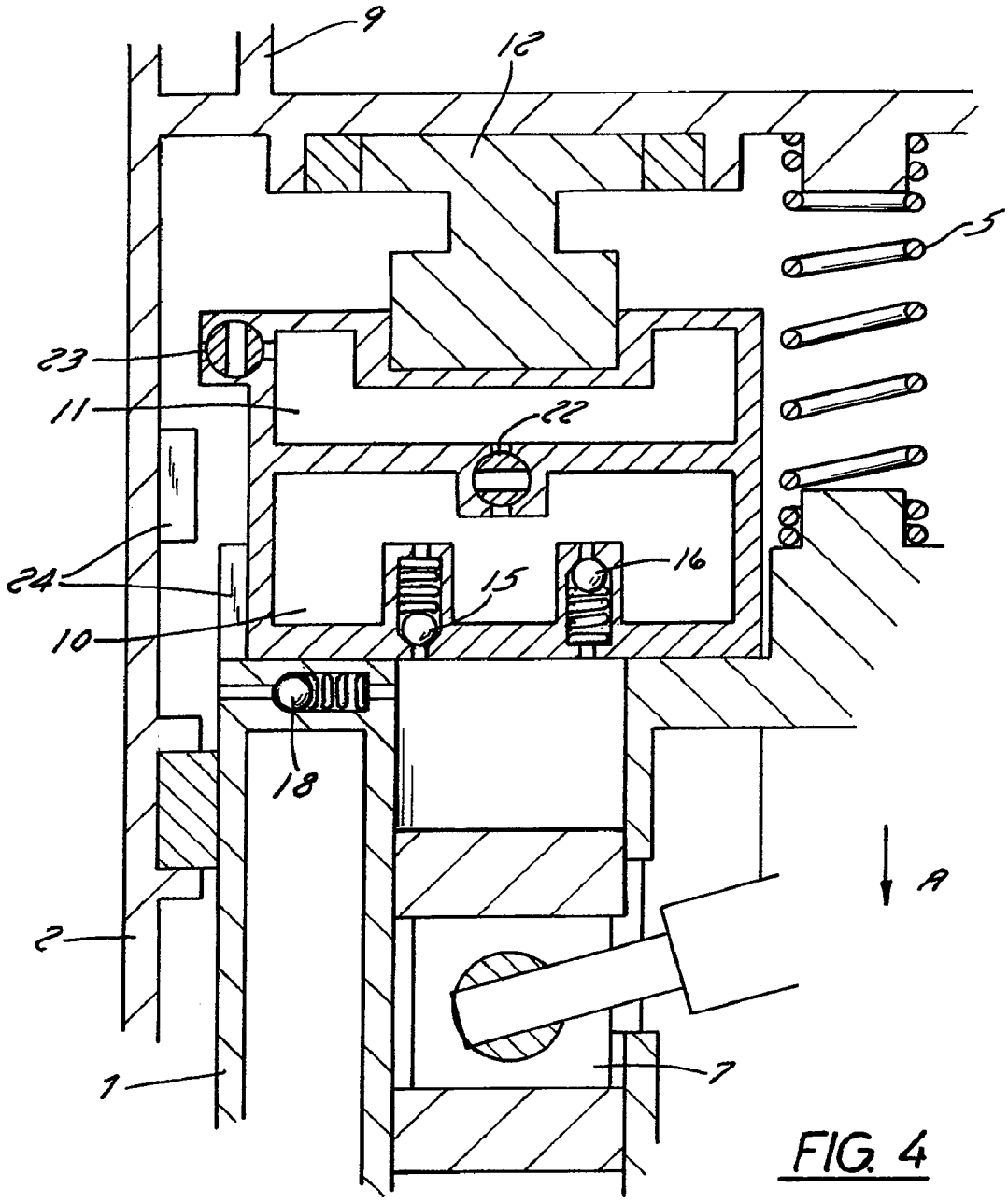
FIG. 4 shows an enlarged detail of another specific embodiment.

FIG. 4 shows a second specific embodiment of the present invention. While in FIGS. 2 and 3 a purely mechanical solution was presented, FIG. 4 relates to a mechatronic realization of the present invention. Insofar as components are used that are essentially identical to those in FIGS. 2 and 3, the same reference characters are also used. A repeated description of these components can be omitted.

An essential difference can be seen in the valve device. The flow of air to and from handle air spring 11 is ensured with the aid of valves that can be controlled by a control unit (not shown), namely an inlet valve 22 and an outlet valve 23.

The control unit receives an essential piece of information from a sensor 24, by which the relative position between first unit 1 and second unit 2 is acquired. Sensor 24 can be an arbitrary proximity sensor, e.g. a Hall sensor. Sensor 24 should be fashioned so as to acquire the relative position of the two units 1, 2 at least in the sought optimal range.

If, with the aid of sensor 24, the control unit determines a displacement of second unit 2 due to an operating force acting on handle 9, then through corresponding controlling of inlet valve 22 or outlet valve 23 it effects a change in the rigidity of handle air spring 11. Handle piston 12 and handle 9 are correspondingly displaced in the desired manner.

The control unit is able to permit a certain range of fluctuation that depends essentially on the available spring travel of spring device 5.

The actuating frequency of the actuator, determined by the control unit, can be smaller than the frequency of the vibration produced in the first unit. In this way, the demands on the control unit and the components of the actuator are comparatively low. However, it is also possible to select the actuating frequency of the actuator to be higher than the vibration frequency. The actuator would then be able to actively counteract the vibration. However, this presupposes a correspondingly fast control unit and fast valves 23, 24.

Figure 5:
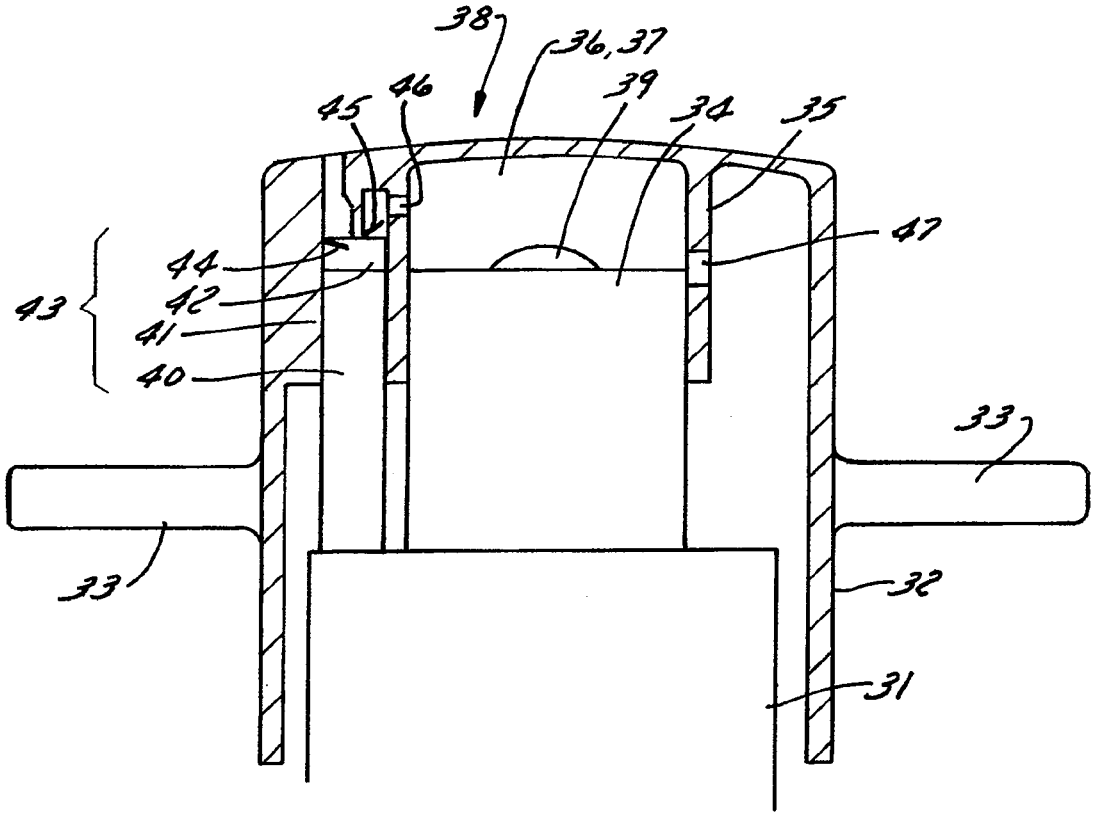
FIG. 5 shows a schematic section through a working tool having the device according to the present invention for vibration isolation of a handle.

FIG. 5 shows a schematic section through a working tool having the device according to the present invention for the vibration isolation of a handle.

In FIG. 5, a section is shown through an upper or rear part, facing away from a tool, of an impact hammer used as a working tool.

The device according to the present invention is particularly well-suited for handheld working tools in which vibrations or shocks are produced, in order to achieve the desired operational effect. The important thing here is to protect the operator guiding or holding the working tool from the vibrations and shocks.

In FIG. 5, a vibration exciter 31 is shown only schematically, as a housing box. Among other components, it has for example a drive, such as an electric motor or a combustion motor, and a movement conversion device. The movement conversion device converts the movement, standardly produced by the drive as a rotational movement, into a slower rotational movement suitable for the respective application, or also into an oscillating back-and-forth movement. Thus, for example, it is standard to realize the movement conversion device as a transmission having a crank drive that drives a hammer mechanism. With the aid of an impact piston, the hammer mechanism produces shocks that are conducted to a tool, for example a chisel.

Besides the impact hammer shown in FIG. 5, the present invention is typically also suitable for drilling hammers or stampers or other working tools in which a vibration decoupling of the handle is desirable.

The part of the working tool in which vibrations or shocks are generated is thus designated vibration exciter 31. This term is to be considered as standing for various constellations that can be selected by someone skilled in the art, depending on the type of working tool.

Vibration exciter 31 is coupled to a grip device 32, realized in FIG. 5 as a grip cover. Grip device 32 can partly surround vibration exciter 31, as shown in FIG. 5. However, it can also be spatially separated from vibration exciter 31.

Grip device 32 can be moved relative to vibration exciter 31 at least along a main direction A. For this purpose, a known guide device (e.g. by means of parallel oscillations; not shown in FIG. 5) is provided between grip device 32 and vibration exciter 31. In addition, grip device 32 can also be capable of movement in other directions relative to vibration exciter 31, differing from main direction A, if this is technically not preventable or is even desired.

On grip device 32, two handles 33 are provided by which the operator can hold and guide the working tool. Numerous variants for the design of handles 33 are also known. For example, in a drilling hammer, instead of the two handles 33 a single handle can be used, in the form of a pistol or spade handle.

An air spring piston 34 is fastened to vibration exciter 31. The air spring piston is surrounded by a spring cylinder 35, formed by part of the wall of grip device 32, so that an air spring chamber 36 forms in a hollow space between air spring piston 34 and spring cylinder 35, which chamber houses the actual air spring 37. It can be seen that the air pressure in air spring 37 increases when grip device 32 is pressed closer to vibration exciter 31 in direction A. Air spring piston 34, spring cylinder 35, air spring chamber 36, and air spring 37 together form a spring device 38.

On the upper side of air spring piston 34, an elastic stop 39 is provided against which grip device 32 can strike if the force excited in direction A is great enough that air spring 37 is completely compressed, or if air spring 37 contains too little air to ensure a sufficient spring effect. Elastic stop 39 ensures that a certain vibration isolation of grip device 32 is ensured even if grip device 32 is in direct contact, via stop 39, with air spring piston 34, and thus with vibration exciter 31.

In addition, a pump piston 40 is provided at vibration exciter 31 that is surrounded by a part of the wall of grip device 32 acting as pump cylinder 41. Pump cylinder 41 surrounds pump piston 40 in such a way that a pump chamber 42 is formed. In this way, an air pump 43 is formed.

Via a one-way valve or first check valve 44, air can flow from the surrounding environment of the working tool into pump chamber 42 when grip device 32 moves away from vibration exciter 31, causing the volume of pump chamber 42 to become larger. The partial vacuum that thus arises suctions the air into pump chamber 42 via first check valve 44.

If, in contrast, grip device 32 is moved in direction A towards vibration exciter 31, the volume of pump chamber 42 becomes smaller, so that the air under pressure can flow into air spring chamber 36 via a second check valve 45 and an inlet opening 46. The air is prevented from flowing back into the surrounding environment by first check valve 44. In this way, the air pressure in air spring chamber 36 is increased, and the rigidity of air spring 37 is increased.

Because vibration exciter 31 produces essentially continuous vibrations, or continually recurring shocks and vibrations resulting therefrom, vibration exciter 31 tends to constantly move back and forth. In contrast, grip device 32 held by the operator should remain as stationary as possible. Thus, during the operation of the working tool there results a continuous relative movement between grip device 32 and vibration exciter 31, which, with the aid of air pump 43, produces an air stream that is constant, averaged over a certain period of time.

The air supply flow into air spring chamber 36 comes to a standstill when the air pressure produced by air pump 43 is not greater than the pressure prevailing in air spring chamber 36. In any case, at this point air spring 37 has achieved its maximum possible rigidity. Air pump 43 and spring device 38 should correspondingly be designed such that even given the theoretical maximum stress (maximum force applied by the operator in direction A), a separation is ensured between grip device 32 and vibration exciter 31, so that the vibrations that arise in vibration exciter 31 can be transmitted to grip device 32 only via air spring 37, but not via additional solid-body contacts, and also not via stop 39.

An outlet opening 47 is fashioned in the wall of grip device 32. Outlet opening 47 is positioned such that, depending on the relative position between grip device 32 and vibration exciter 31, it is covered or not covered by air spring piston 34, acting as a sliding valve. As can be seen in the Figure, air spring piston 34 covers outlet opening 47, acting as a valve opening, when grip device 32 approaches vibration exciter 31 past a certain point. This will be the case in particular if the operator presses in direction A with a correspondingly great holding or pressure force.

In this case, the air pressure in air spring 37 is increased by the continuous supply of air from air pump 43 until air spring 37 is strong enough to press grip device 32 back against the pressure force of the operator, and thus opposite to direction A. Here, grip device 32 is moved back until air spring piston 34 at least partly again exposes outlet opening 47. This is because at this point air can flow from air spring 37 to the surrounding environment via outlet opening 47, so that the air pressure in air spring 37 decreases again. Due to this reduction of the air pressure in air spring 37, grip device 32 can in turn again move closer to vibration exciter 31.

In this way, a regulation, acting as a spring regulating device, is ensured, on the basis of which the relative position between grip device 32 and vibration exciter 31 is maintained within a defined operating range at all times, preferably even in a target position, even given changing external, essentially static, forces, such as e.g. the holding force of the operator. The target position will in most cases correspond to a position in which air spring piston 34 partially covers outlet opening 47 in the manner shown in the Figure. An equilibrium will then arise between the air supply stream from air pump 43 and the exhaust stream via outlet opening 47, so that the spring force produced by air spring 37 corresponds to the force acting from outside.

As a target position for the regulation of air spring 37, a center position is especially suitable, in which approximately equal movement paths of grip device 32 towards vibration exciter 31 and away from vibration exciter 31 are ensured. In this way, vibration exciter 31 can execute a good oscillation relative to grip device 32.

The regulation of air spring 37 has a certain desired inertia. In particular, the vibration frequencies of the vibration exciter are significantly greater than the frequencies of the regulating speed, so that the vibrations do not change the spring rigidity of air spring 37, or change it only negligibly. The spring characteristics are thus predominantly or exclusively changed by the force acting externally on grip device 32, and thus on vibration exciter 31, above all the holding force of the operator.

Correspondingly, air spring 37 compensates the higher-frequency vibrations of vibration exciter 31, so that an effective vibration isolation of grip device 32 takes place.

In another specific embodiment of the present invention, not shown in FIG. 5, the exhaust air flow from air spring 37 is constant, while the air supply flow from the air pump is correspondingly controlled or regulated in order to achieve the desired modification of the spring characteristics of air spring 37.

In yet another specific embodiment, it is possible to regulate both the air supply stream and also the exhaust air stream.

Instead of the above-described air pump, other solutions are also conceivable in which air can be produced having a particular pressure value. Thus, for example it is possible to produce the compressed air directly in vibration exciter 31, e.g. by the drive provided there. Corresponding fan impellers are for example suitable for this purpose.

In another variant, a movable mass oscillator, moved back and forth by the vibrations of the vibration exciter, is situated between vibration exciter 31 and grip device 32.

Of course, the assignment of the components belonging to spring device 38 and to air pump 43 to grip device 32 and to vibration exciter 31 can also easily be reversed. The achievable effect remains unchanged.

It is particularly advantageous if air spring 37 has an increased rigidity during no-load operation of the working tool. In particular in the hammer shown in FIG. 5, when the hammer is placed on a new drilling point there is the danger that the hammer will jump away from the point of application. If air spring 37 is correspondingly rigid in no-load operation, the operator can guide the hammer better and can carry out the initial drilling. For this purpose, air spring piston 34 can for example be constructed such that in a relative position in which grip device 32 is far removed, i.e. pushed back in relation to vibration exciter 31, it covers outlet opening 47. Air spring piston 4 does not expose outlet opening 47 until grip device 32 is pressed against vibration exciter 31, so that the rigidity of air spring 37 is first significantly reduced. In this way, grip device 32 can move into the desired target position (e.g. center position) before air spring piston 34 again closes outlet opening 47 in the manner described above. In order to realize this controlling, corresponding control grooves can be provided in side walls of air spring piston 34 that connect air spring 37 to outlet opening 47, depending on their relative position.

Through the fact that the holding force of the operator, in particular the pressure force, and the weight of the working tool to be held by the operator are in equilibrium with one another, the operating point of the spring characteristic of air spring 37 can be kept at all times in a range that permits the greatest possible vibration of vibration exciter 31 relative to grip device 32. In this way, the vibrations and shocks are effectively isolated from grip device 32.

In general, there is the problem that, given a supply of fresh air via check valve 44, dust and dirt can enter into the interior of the tool, in particular into air pump 43, a corresponding alternative air pressure-producing device, or into air spring 37 itself. In order to prevent this, it should be sought to guide the air exiting air spring 37 via outlet opening 47 into a closed circuit of air pump 43 or of another air pressure-producing device, whereby the air can then be pumped into air spring 37 again. In this way, an air feedback circuit is achieved in which only the air that has escaped due to leakage must be replaced. Essentially, however, through the feedback mechanism, the same air can be constantly reused for air spring 37.

A working tool according to the present invention thus has an air spring between the vibrating first unit and the second unit (e.g. handle) that is to be kept still. The spring characteristics of the air spring can advantageously be modified due to the fact that the degree of filling of the air spring, or the air pressure in the air spring, can be modified. For this purpose, proposals have been described above for air pressure-producing devices, as well as for spring regulating devices. In a particularly advantageous manner, either the drive of the working tool can enable the required production of air pressure, for example via a drive piston of the pneumatic spring hammer mechanism. Alternatively, the oscillating relative movement between the first and the second unit can be used to produce a pump movement in order to convey the air and to produce the compressed air. In particular via simple mechanical regulating devices, it is possible to constantly adapt the air pressure in the air spring, or its filling with air, to the particular conditions that obtain, i.e., above all the pressure force applied by the operator.

We Claim:

1. A handheld working tool, comprising:

a first unit excited by vibration during operation, a second unit that is capable of being moved at least in a working direction (A) relative to the first unit, and a vibration isolation device situated effectively between the first unit and the second unit, the vibration isolating device having at least one actuator for producing an actuating force with which an operating force acting in the working direction (A) between the first unit and the second unit is able to be at least partly compensated, and the actuator being pneumatically operated, wherein the actuator has a handle air spring whose filling with compressed air is able to be modified, and wherein a spring device is situated parallel to the actuator, between the first unit and the second unit, wherein the working tool is a drilling and/or impact hammer, the second unit has a handle, in the first unit there is provided a pneumatic spring hammer mechanism having a drive piston driven by a motor for driving an impact piston by means of an air spring that is able to be produced between the drive piston and the impact piston, and wherein the drive piston is fashioned for the production of compressed air for supplying the actuator.

2. The working tool according to claim 1, wherein the actuator has a compressed air storage device that is able to be filled with compressed air by the drive piston.

3. The working tool according to claim 2, wherein the actuator has the compressed air storage device, a valve device, the handle air spring, and a handle piston, the compressed air storage device is able to be connected to the handle air spring via the valve device, and wherein the handle air spring acts on the handle piston that is connected to the handled.

4. The working tool according to claim 3, wherein the valve device is fashioned such that, when the handle piston reduces a volume enclosing the handle air spring beyond a predetermined value, compressed air is able to be supplied to the handle air spring from the compressed air storage device in order to restore the predetermined value for the volume of the handle air spring.

5. The working tool according to claim 3, wherein the valve device has an outlet valve for letting compressed air out of the handle air spring when the volume of the handle air spring exceeds a predetermined maximum value due to a displacement of the handle piston.

6. A handheld working tool, comprising:

a first unit excited by vibration during operation, a second unit that is capable of being moved at least in a working direction (A) relative to the first unit, and a vibration isolation device situated effectively between the first unit and the second unit, the vibration isolating device having at least one actuator for producing an actuating force with which an operating force acting in the working direction (A) between the first unit and the second unit is able to be at least partly compensated, and the actuator being pneumatically operated, wherein- the actuator has a handle air spring whose filling with compressed air is able to be modified, and wherein a spring device is situated parallel to the actuator, between the first unit and the second unit, wherein a sensor is provided for determining the relative position of the first unit and the second unit, and wherein the sensor and a valve device are connected to a control unit, and wherein, the valve device is able to be controlled by the control unit in such a way that in the handle air spring a compressed air state prevails such that the relative positions, acquired by the sensor, of the first unit and the second unit are kept in a predetermined range of fluctuation.

7. A handheld working tool, comprising:

a first unit excited by vibration during operation, a second unit that is capable of being moved at least in a working direction (A) relative to the first unit, and a vibration isolation device situated effectively between the first unit and the second unit, the vibration isolating device having at least one actuator for producing an actuating force with which an operating force acting in the working direction (A) between the first unit and the second unit is able to be at least partly compensated, and the actuator being pneumatically operated, wherein the actuator has a handle air spring whose filling with compressed air is able to be modified, and wherein a spring device is situated parallel to the actuator, between the first unit and the second unit, wherein an air pressure-producing device, driven by a motor of the working tool, is provided in order to produce compressed air for the actuator.

* * * * *